US007436363B1

(12) United States Patent
Klein et al.

(10) Patent No.: US 7,436,363 B1
(45) Date of Patent: Oct. 14, 2008

(54) STACKED MICROSTRIP PATCHES

(75) Inventors: Joseph Klein, Chatsworth, CA (US); Vladimir Kimelblat, Chatsworth, CA (US)

(73) Assignee: Aeroantenna Technology, Inc., Chatsworth, CA (US)

( * ) Notice: Subject to any disclaimer, the term of this patent is extended or adjusted under 35 U.S.C. 154(b) by 0 days.

(21) Appl. No.: 11/864,261

(22) Filed: Sep. 28, 2007

(51) Int. Cl.
*H01Q 1/38* (2006.01)

(52) U.S. Cl. ..... 343/700 MS; 343/757; 343/763; 343/841

(58) Field of Classification Search ..... 343/700 MS, 343/757, 763, 761, 766, 841, 879
See application file for complete search history.

(56) References Cited

U.S. PATENT DOCUMENTS 5,200,756 A 4/1993 Feller
5,210,542 A * 5/1993 Pett et al. ..... 343/700 MS
5,382,959 A * 1/1995 Pett et al. ..... 343/700 MS
6,236,367 B1 5/2001 Du Toit et al.
6,392,600 B1 * 5/2002 Carson et al. ..... 343/700 MS
6,650,294 B2 11/2003 Ying et al.
6,795,021 B2 * 9/2004 Ngai et al. ..... 343/700 MS
6,940,457 B2 * 9/2005 Lee et al. ..... 343/700 MS
2007/0296635 A1 * 12/2007 Popugaev et al. ..... 343/700 MS

* cited by examiner

*Primary Examiner*—Douglas W. Owens
*Assistant Examiner*—Chuc Tran

(57) ABSTRACT

The present invention is a dual frequency and circularly polarized microstrip antenna with a ground plane, a mid layer above the ground plane with a parasitically driven resonant mid patch (for transmissions at a second frequency), a top layer with a directly driven patch parasitically driving the mid patch (for transmissions at a first frequency), and parasitic elements.

16 Claims, 3 Drawing Sheets

STACKED MICROSTRIP PATCHES

BACKGROUND OF THE INVENTION

The present invention relates to microstrip antennas with parasitic elements.

The prior art describes several design parameters for microstrip antennas. Surface waves are excited whenever a microstrip antenna has a substrate with the relative dielectric constant is greater than 1 ($\in_R>1$). Since many preferred substrates for microstrip antennas have relative dielectric constants that range from about 2.5 (for PFTE) to 25 or higher, the problem of surface waves is one that must be mitigated or, rarely, eliminated. Surface waves interfere with desired antenna gain, bandwidth, and cross-polarization levels for microstrip antennas.

The stability of a phase center for a microstrip antenna is a critical design parameter for precision measurement GPS devices (cm or mm level accuracy) made for surveyors. GPS survey devices with microstrip antennas all experience some phase center variation, resulting in positional errors. The degree of unwanted variation of phase center is partly a function of the cross-polarization levels. Reducing phase center variation may be accomplished by reducing the cross-polarization levels or improving the circularity of survey antennas. The phase center of an antenna is located at the apparent center of curvature of the radiated equiphase surface for a given component of the far field radiation, assuming the equiphase surface is spherical or at least locally spherical.

So, there is a need to form a microstrip antenna with high quality circular polarization to reduce phase center variation. In fact, high quality circular polarization is a requirement for many satellite communication and sensor technologies. There are many forms of circularly polarized microstrip antennas. Some of the forms of circularly polarized microstrip antennas are circularly shaped or rectangular shaped patches. Circularly shaped or rectangularly shaped microstrip antennas can be fed by direct connection or through electromagnetic coupling. These circularly polarized microstrip antennas may be excited by a single feed or multiple feeds. Multiple feed antennas provide better circular polarization than single feed antennas when an appropriate offset in the feed excitation is used.

SUMMARY OF THE INVENTION

The present invention is a dual frequency and circularly polarized microstrip antenna with:

1. a ground plane,
2. for transmissions at a second frequency, a mid layer located above the ground plane bearing a parasitically driven resonant mid patch, and
3. for transmissions at a first frequency, a top layer patch directly connected with driving means for delivering feeds or transmission signals to the top layer patch, thereby parasitically driving transmissions from the mid patch, and
4. parasitic elements (hereafter referred to as "parasitic patches") arranged about a periphery of the mid patch to form an array parasitically driven to emit transmission signals.

Although stacked patches or microstrip antennas are well known to obtain circular polarization, the present invention adds non-resonant and non-capacitively driven parasitic patches at the mid level between the ground plane and the top level to obtain remarkable and unexpected benefits.

One specific form of the invention directs four mutually orthogonal feeds to a circular top patch. The four feeds are equal amplitude currents having 0°, 90°, 180° and 270° phase differentials. In a specific example, the top patch and mid patch are both circular and are each supported on a thin dielectric layer, spaced apart from the other layer by an air gap. The top patch is parasitically coupled to a mid patch. In a specific example, a circular mid patch is larger than a circular top patch. Many sizes and shapes of the top patch and mid patch may accomplish the objects of the invention so long as both are at least resonant.

Both patches are effectively stacked above the ground plane. In a specific example, the mid patch has a small diameter circular aperture at the center. Eight parasitic patches in a roughly curved quadrilateral shape are arranged spaced apart from a periphery of the mid patch on the mid level around a common axis of the mid patch and the top patch. The parasitic patches are parasitically driven by performance of the mid and top patches. Each parasitic patch is connected to the ground plane by a shorting pin.

It is an object of the invention to provide reduced back radiation compared to other dual frequency circularly polarized stack patches.

It is an object of the invention to provide an antenna with increased overall gain compared with other dual frequency circularly polarized stack patches.

It is an object of the invention to provide an antenna with excellent circularity at all radiation angles for the hemisphere above the ground plane.

It is an object of the invention to provide an antenna with performance at least the equal of the choke ring style of antenna while at the same time having the advantage of being lighter in weight and smaller in size.

It is an object of the invention to provide an antenna with cross-polarization rejection capability so that the antenna will perform well in high quality GPS applications where multipath is a primary concern.

It is an object of the invention to provide an antenna with combination of good gain and excellent circularity to make it an antenna of choice for GPS applications where accuracy is of primary concern.

It is an object of the invention to provide an antenna for receiver and transmitter applications where back radiation is a concern.

It is an object of the invention to provide an antenna for applications where high aperture efficiency is needed, e.g., high gain antennas comprised of elements to create an array.

DETAILED DESCRIPTION OF THE INVENTION

The invention is now discussed with reference to the figures.

Figure 1:
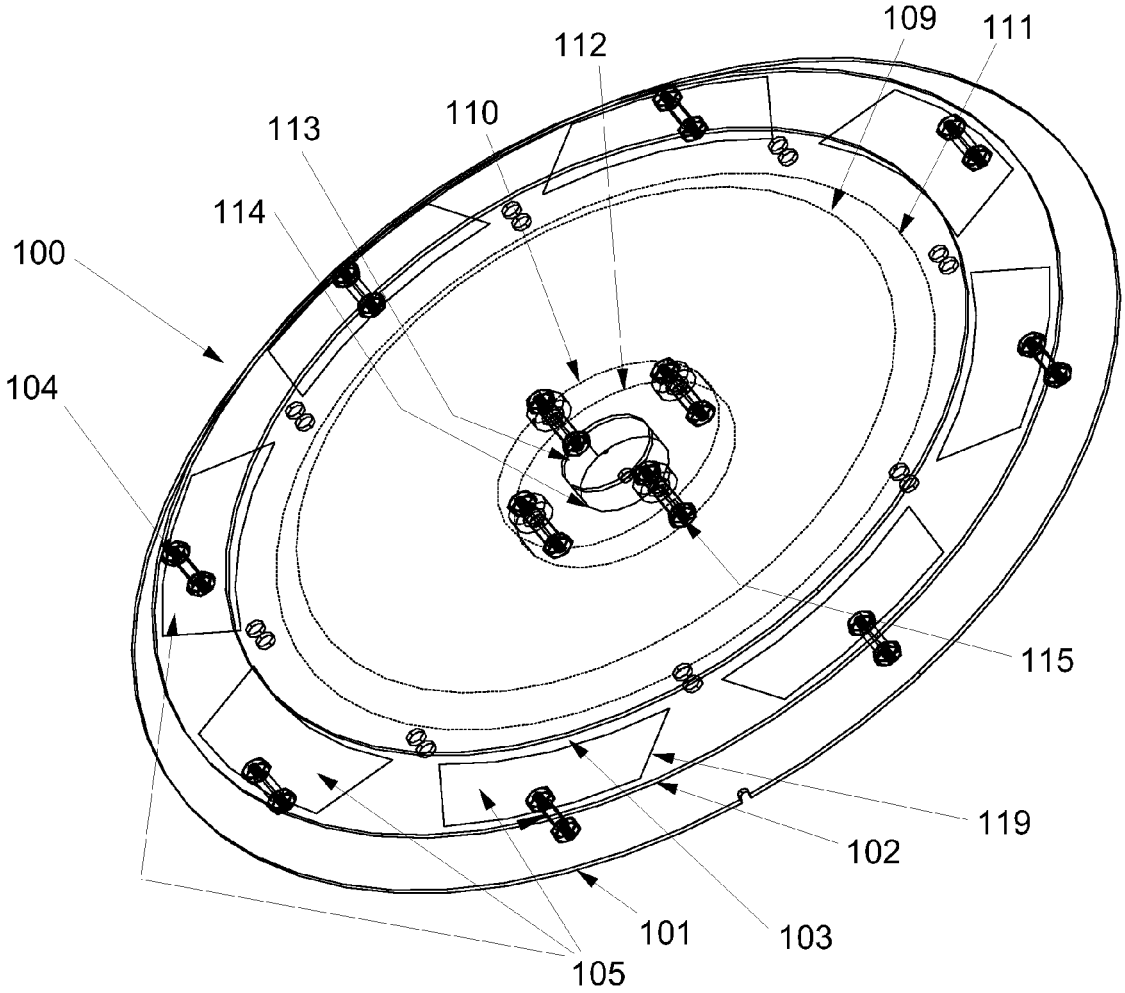
FIG. 1 is a top perspective view of a circularly polarized form of the invention.
Figure 2:
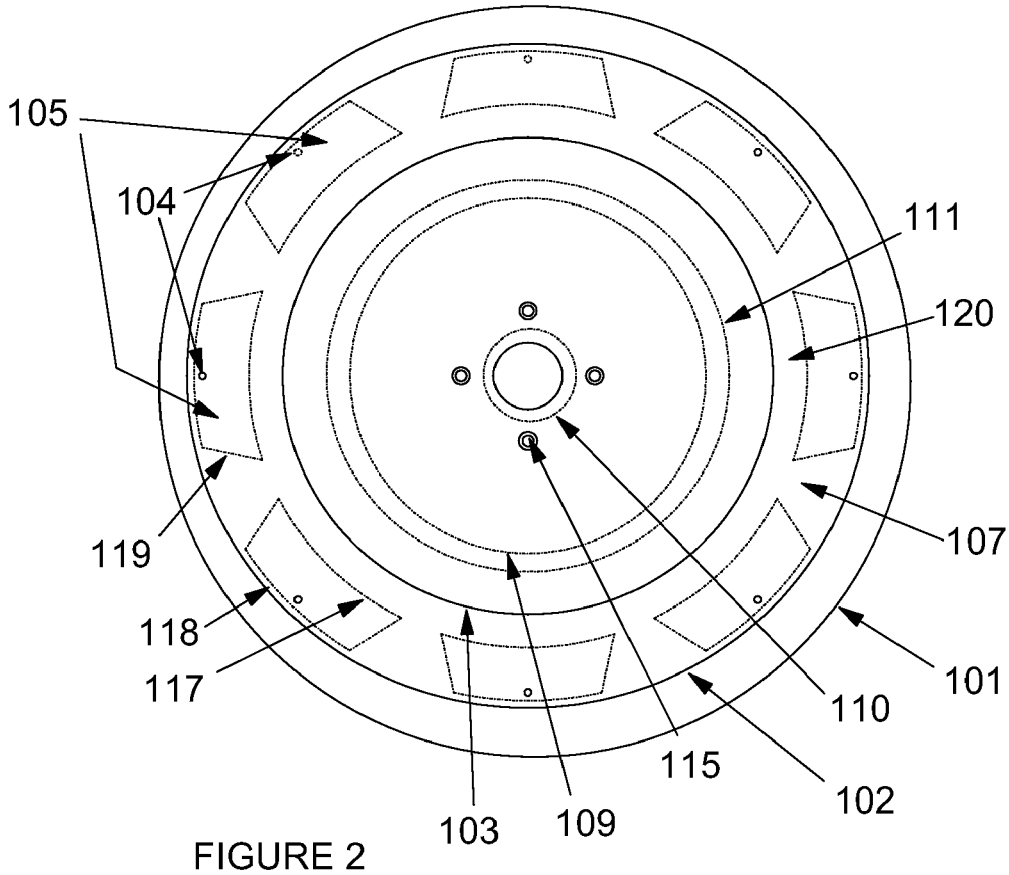
FIGS. 2 and 3 are respectively top and side views of the device of FIG. 1.
Figure 3:
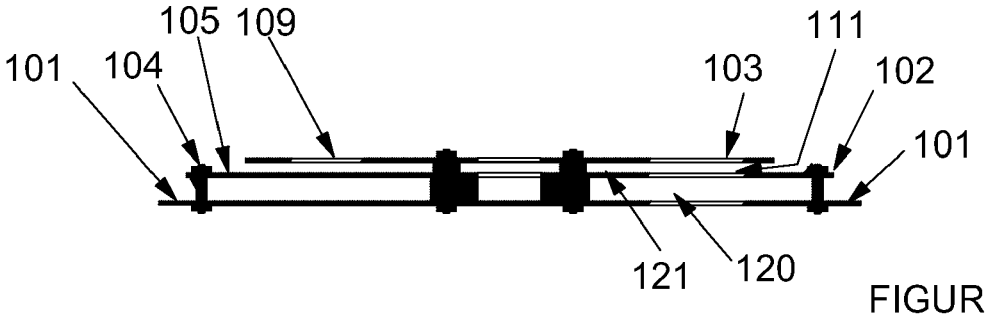

Antenna 100 is shown in FIGS. 1 through 3 having three support layers 101, 102 and 103 for respectively a ground layer, a mid layer, and a top layer. Layers 101, 102 and 103 are formed of an appropriate dielectric material. Layer 101 is connected with appropriate circuitry so that is acts as a ground layer for microstrip patches formed on layers 102 and 103, respectively a mid microstrip patch with outer boundary 111 and a top microstrip patch with inner boundary 110 and outer boundary 109. The mid and top patches of FIGS. 1-3 are circular for circular polarization.

It is within the objects of the invention to provide the non-resonant patches 105 on layer 103 with other types of microstrip antennas, more preferably those generating dual frequencies in a stacked arrangement. The stacked microstrips may be circular, as in FIGS. 1-3, square, as in FIG. 5, formed in a halfwave or quarterwave dipole, or in other such stacked arrangements that are known in the art. The non-resonant and parasitic patches 105 set on a mid layer 102 at the periphery of a mid patch are a critical part of the present invention.

Each of layers 102 and 103 comprise a circular hole 114 and 113 respectively and are held apart by top patch feed spacers 115. Layer 102 is held apart from layer 101 by shorting pins 104, which short to the ground layer each of the patches 105. Each of the patches 105 in the specific example of FIGS. 1-3 comprise an outline having an inside arc 117, outside arc 118 and slanted sides 119. Arcs 117 of patches 105 are separated from the outer boundary 111 of the mid patch by annular space 120.

More detailed specifications for a preferred embodiment of the invention antenna of FIGS. 1-3 are as follows:

1. For the top patch, the diameter of the outer boundary 109 is about 92 millimeters, the diameter of the inner boundary 110 is about 16 millimeters, the diameter of the hole 113 is about 16 millimeters, the thickness of the dielectric material provided to support layer 101 is about 0.8 millimeters; the radial distance from a central axis of the mid and top patches to top patch feed spacers 115 is about 16 millimeters, and the resonant frequency is about $1575\times10^9$ Hz.
2. For the mid patch, the diameter of the outer boundary 111 is about 112.5 millimeters, the diameter of the inner boundary 112 is about 38 millimeters, the diameter of the hole 114 is about 15 millimeters, the thickness of the dielectric material provided to support layer 102 is about 1-3 millimeters, the air gap between the bottom of layer 103 and the top of layer 102 is about 2.3 millimeters, and the resonant frequency is about $1\ 227\times10^9$ Hz.
3. For the parasitic patches 105, the annular space 120 is about 5 millimeters, the arc lengths 117 and 118 are about 10 and 34 respectively with arc radius ends at the central axis of the mid and top patches, the sides 119 have lengths of about 14 millimeters; and the radial distance of the shorting pins 104 from the central radius is about 74 millimeters.
4. For the bottom layer, 101 the thickness of the dielectric material provided to support layer 101 is about 0.8 millimeters, the air gap between the bottom of layer 102 and the top of layer 101 is about 5 millimeters.
5. Frequency bandwidth for the top and mid patches are effectively separated.
6. Side lobe suppression: The side lobes are completely suppressed.

Figure 4:
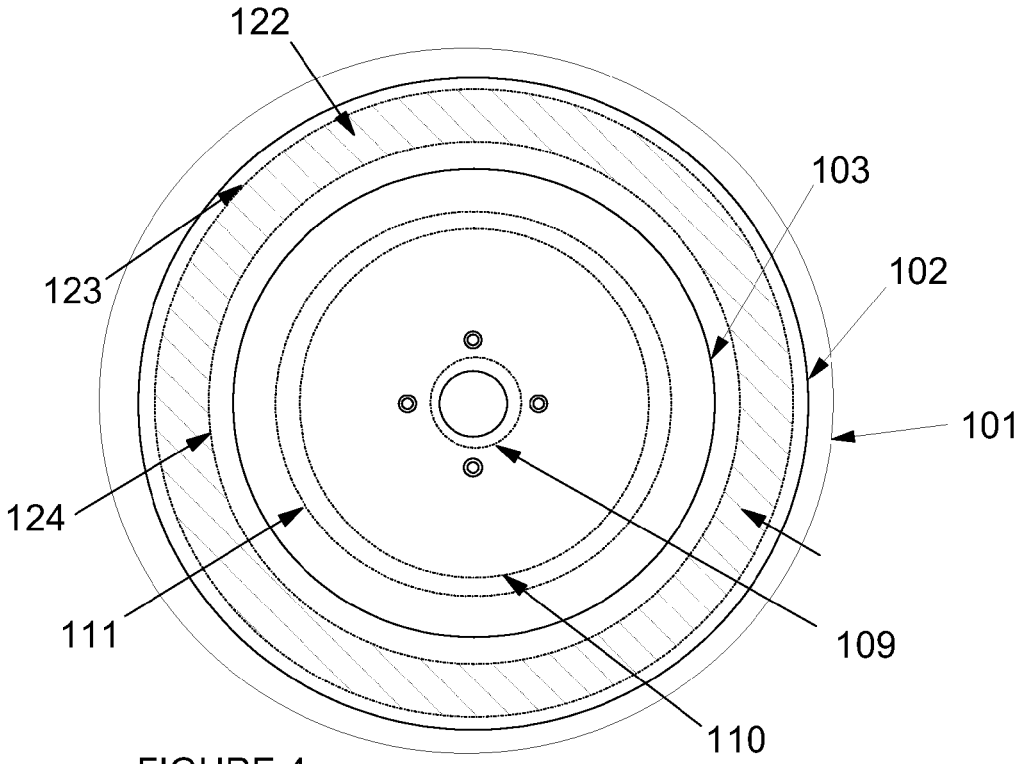
FIG. 4 is an alternate form of the device of FIG. 1.

FIG. 4 shows an alternate form of patches 105 of FIGS. 1-3, i.e., microstrip patch 122 is continuous with an inside arc 124 as an inner boundary and outside arc 123 as an outer boundary. The invention parasitic patches may be separated or continuous, or comprising any of several separated geometric shapes to obtain the objects of the invention.

Figure 5:
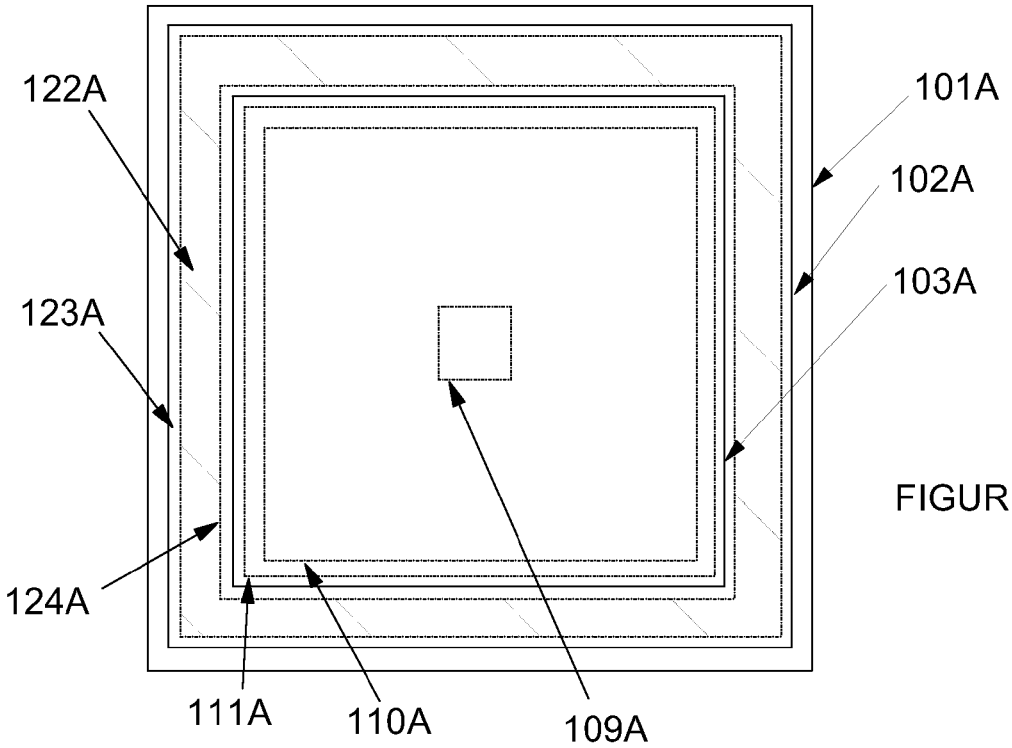
FIG. 5 is an alternate form of the device of FIG. 4.

FIG. 5 shows a square patch form of the invention, where a top patch with boundaries 109A and 110A on layer 103A corresponds to the top patch of FIG. 4, a mid patch with an inner boundary and outer boundary 111A on layer 102A corresponds to the mid patch of FIG. 4, and parasitic patch 122A with boundaries 123A and 124A corresponds to the parasitic patch of FIG. 4.

The present invention may be adapted to many forms of stacked patch antennas using non-resonant parasitic patches at a mid layer 102.

It will be appreciated by the skilled person from the above description that the following are aspects and benefits of the invention.

The top and mid patches are dual frequency and resonant with respect to each other, this combination operating as an exciter for the parasitic patches.

The top patch is directly excited through spacers 115, where all other radiating components, i.e., the mid patch and parasitic patches, are parasitically coupled. It is a critical difference of this invention's parasitic patches as compared with those of the prior art that this invention's parasitic patches are substantially not capacitively coupled with the other radiating elements.

In a preferred specific example, separated parasitic patches are approximately symmetrically placed about an antenna axis, i.e., the central axis.

The antenna consists of a directly fed top patch and a parasitically driven mid patch and a parasitic patch array arranged around the driven mid patch antenna. The parasitic patch array is excited by the driven antenna, whereafter the parasitic patch array acts as a secondary antenna that contributes to the overall antenna radiation. The antenna radiation resulting from the combination of the driven antenna and the driven array of parasitic patches is circularly symmetrical. This antenna radiation comprises substantially equal E-plane and H-plane radiation with relatively low back lobe radiation. The relatively high degree of circular symmetry of the invention antenna radiation necessarily results in a substantial improvement in stabilizing the phase center and circular polarity.

The present invention improvement in antenna operation may be explained in part with analogy to corrugated horn antennas. Corrugated horn antennas operate with E-plane and H-plane patterns substantially equalized, while current flow external to an aperture is minimized. Corrugated horn antennas are used in antennas that feed parabolic shaped reflectors, where the circular symmetry and reduced back radiation contributes to more efficient radiation from parabolic surfaces.

The objects of the present invention also include the following concepts. Antenna gain will be a maximum with using a largest radiating antenna projecting a single beam. Blocking the current flow from the directly driven top patch back to the ground plane through operation of the patch elements results in minimizing back radiation. The present invention achieves a high degree of circular polarity from vertical all the way down to the antenna horizon.

The prior art choke ring antenna, while achieving some of the objects of this invention, is large, bulky and must use resonant quarter wave rings. The present invention achieves all the radiation benefits of the choke ring antenna while forming a device with a much smaller and lighter structure.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

We claim:

1. A dual frequency antenna comprising:

(a) a ground plane, a mid layer, and a top layer spaced apart from each other in that sequence;

(b) driving means connected with the ground plane for activating microstrip patches on the mid layer and top layer;

(c) the mid layer comprising a central part and a peripheral part separated by an annular part;

(d) a top microstrip patch fixed on the top layer and directly connected to feed means adapted to deliver transmission signals to the top microstrip patch;

(e) a mid microstrip patch fixed in the central part of the mid layer and adapted to be driven parasitically by the top microstrip patch; and (f) one or more parasitic elements arranged in the peripheral part of the mid layer and adapted to form an array around and separated from the mid microstrip patch.

2. The antenna of claim 1 wherein two or more parasitic elements comprise discrete and symmetrically arranged elements.

3. The antenna of claim 1 wherein the top microstrip patch and the mid microstrip patch are circular.

4. The antenna of claim 3 wherein the antenna is adapted to be operated with circular polarization.

5. The antenna of claim 1 wherein the top microstrip patch and the mid microstrip patch are square.

6. The antenna of claim 5 wherein a single parasitic element is square and continuous around the peripheral part of the mid layer.

7. The antenna of claim 1 wherein the top microstrip patch and the mid microstrip patch are circular and a single parasitic element is circular and continuous around the peripheral part of the mid layer.

8. The antenna of claim 1 wherein the top microstrip patch and the mid microstrip patch are circular and four to eight parasitic elements are arranged substantially symmetrically around the peripheral part of the mid layer.

9. A method of operating a dual frequency antenna comprising:

(a) a ground plane, a mid layer, and a top layer spaced apart from each other in that sequence;

(b) the mid layer comprising a central part and a peripheral part separated by an annular part;

(c) a top microstrip patch fixed on the top layer and connected to feed means adapted to deliver transmission signals to the top microstrip patch;

(d) a mid microstrip patch fixed in the central part of the mid layer and adapted to be driven parasitically by the top microstrip patch;

(e) one or more parasitic elements arranged in the peripheral part of the mid layer and adapted to form an array around and separated from the mid microstrip patch; and (f) operating the feed means to parasitically drive the mid microstrip patch and parasitic elements.

10. The method of claim 9 wherein driving of the mid microstrip patch and parasitic elements substantially blocks a current flow from the top microstrip patch to the ground plane.

11. The method of claim 10 wherein the top microstrip patch and mid microstrip patches are circular and their operation generates substantial circular polarity from normal to the ground plane to an antenna horizon.

12. The method of claim 9 wherein the parasitic elements are not substantially resonant with the top microstrip antenna.

13. The method of claim 12 wherein the parasitic elements are not substantially resonant with the mid microstrip antenna.

14. The method of claim 9 wherein side lobes are substantially reduced or suppressed.

15. The method of claim 9 wherein a first frequency is transmitted from the top microstrip patch.

16. The method of claim 15 wherein a second frequency is transmitted from the mid microstrip patch.

* * * * *